United States Patent [19]

Guenther

[11] Patent Number: 4,778,180

[45] Date of Patent: Oct. 18, 1988

[54] GOLF CLUB

[76] Inventor: Arthur W. Guenther, 2400 St. Francis Dr., Burlington, Ontario, Canada,

[21] Appl. No.: 16,742

[22] Filed: Feb. 19, 1987

[51] Int. Cl.[4] ..... A63B 53/06

[52] U.S. Cl. ..... 273/79; 273/168

[58] Field of Search ..... 273/168, 79, 80.1, 80.2, 273/80 C, 80 R, 80.4

[56] References Cited

U.S. PATENT DOCUMENTS 2,201,638 5/1940 Theibault ..... 273/79

3,868,132 2/1975 Racine ..... 273/80.1

4,174,108 11/1979 Reinholz ..... 273/168

*Primary Examiner*—George J. Marlo

[57] ABSTRACT

A golf club wherein the head has opposed ball striking surfaces and is rotatably mounted to a lower angled end of the club shaft. The head is locked to the shaft in its use position by a pivotable bifurcated lever including cam surfaces which on engagement with the club head tighten a cooperating trunnion fixed to the end of the club shaft.

5 Claims, 3 Drawing Sheets

GOLF CLUB

FIELD OF THE INVENTION

This invention relates to a golf club with a reversible head for use as a putter or as a chipper.

BACKGROUND OF THE INVENTION

A set of golf clubs usually includes, inter alia, a putter for moving a golf ball on the green around a hole and a chipper for driving the ball out of long grass or a sand trap. Each club is an added weight to carry and an added expense to purchase.

It is an object of the present invention to provide a golf club having a reversible head for use either as a putter or as a chipper.

Also, golf clubs are made specifically for left handed or right handed players.

It is a further object of the present invention to provide a golf club having a reversible head for use by either a left handed or a right handed player.

SUMMARY OF THE INVENTION

Essentially the invention consists of a golf club comprising: a shaft; a mounting element fixed on the lower end of the shaft; and a head having opposed striking faces, the head being mounted on the element and rotatable between selected positions presenting each face for play, and means to releasably lock the head in each of said positions.

BRIEF DESCRIPTION OF THE DRAWINGS

An example embodiment of the invention is shown in the accompanying drawings in which.

DESCRIPTION OF A PREFERRED EMBODIMENT

Figure 4:
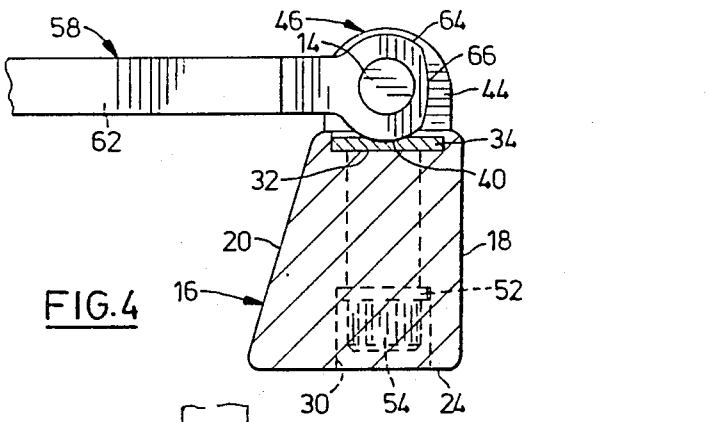
FIG. 4 is a cross-sectional view taken along line 4—4 of FIG. 3.
Figure 3:
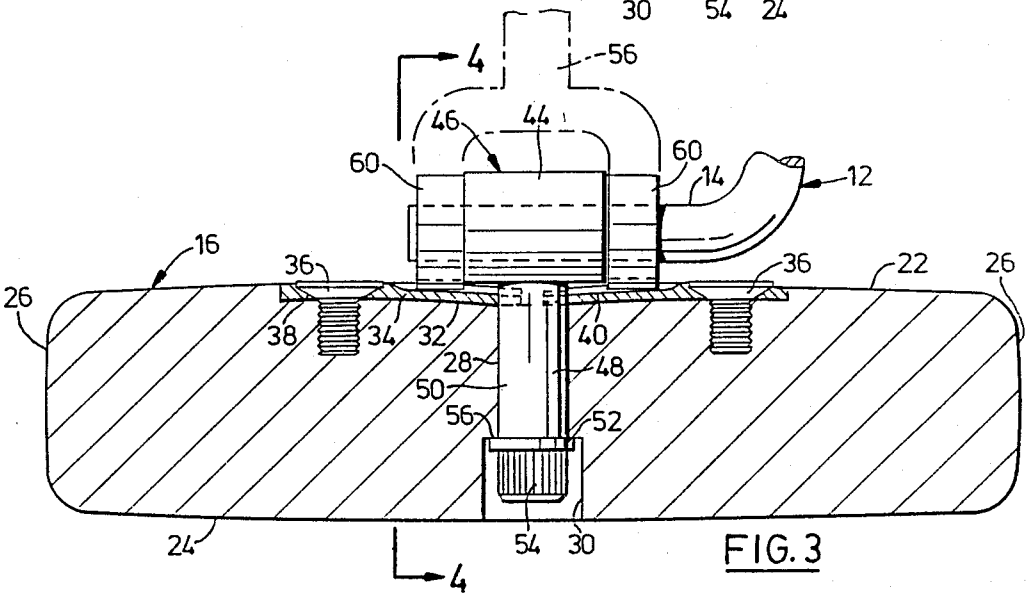
FIG. 3 is a cross-sectional view taken along line 3—3 of FIG. 2.

The example embodiment shown in the drawings consists of a golf club 10 having a shaft 12 at its lower horizontally disposed end 14 terminating in a head 16 with two opposed striking faces, namely a chipper face 18 and a putter face 20, together with a top surface 22, a bottom surface 24 and ends 26.

Centrally located in head 16 is a vertical bore 28 which terminates at its lower end in a widened recess 30 and at its upper end in a shallow elongated recess 32 which tapers downwardly from each end towards the bore. A pair of flat leaf springs 34 rest in recess 32 and are fastened in the recess by screws 36 countersunk in aperture 38 remote from bore 28. Each leaf spring 34 has a shallow depression 40 adjacent bore 28 and an end cut out 42 to conform to the diameter of the bore.

Lower end 14 of shaft 12 is press fitted into a trunnion 44 of a mounting element 46 which carries a laterally projecting pin 48 which is vertically disposed and received in bore 28. Lower end 50 of pin 48 is internally threaded and receives a washer 52 and a knurled nut 54 with the washer bearing against shoulder 56 of recess 30 adjacent bore 28.

A bifurcated lever 58 has a pair of spaced bosses 60 which are loosely mounted on lower end 14 of shaft 12 and straddle trunnion 44 of mounting element 46, and a lever arm 62 extending from the bosses. Bosses 60 are shaped to form a cam, being flattened at that portion of their circumferences remote from lever arm 62 to provide side cam surfaces 64, which project from the circumference of trunnion 44 and lie in depressions 40 of leaf spring 34, and a shallower central cam surface 66.

Figure 1:
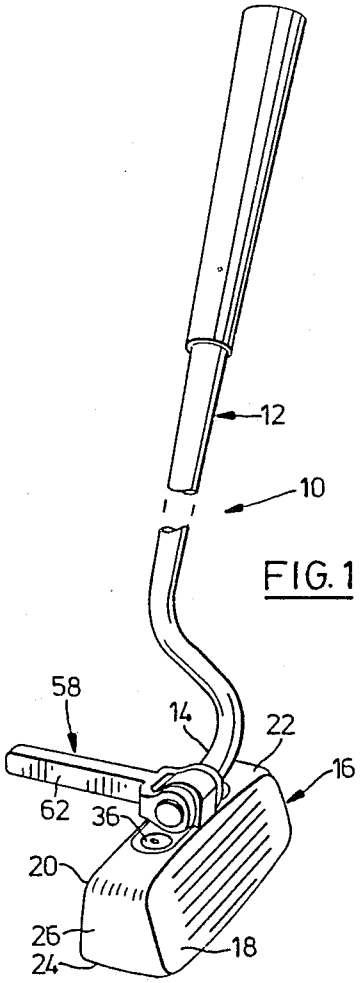
FIG. 1 is a perspective view of a golf club having a reversible head for use as a putter or as a chipper.
Figure 2:
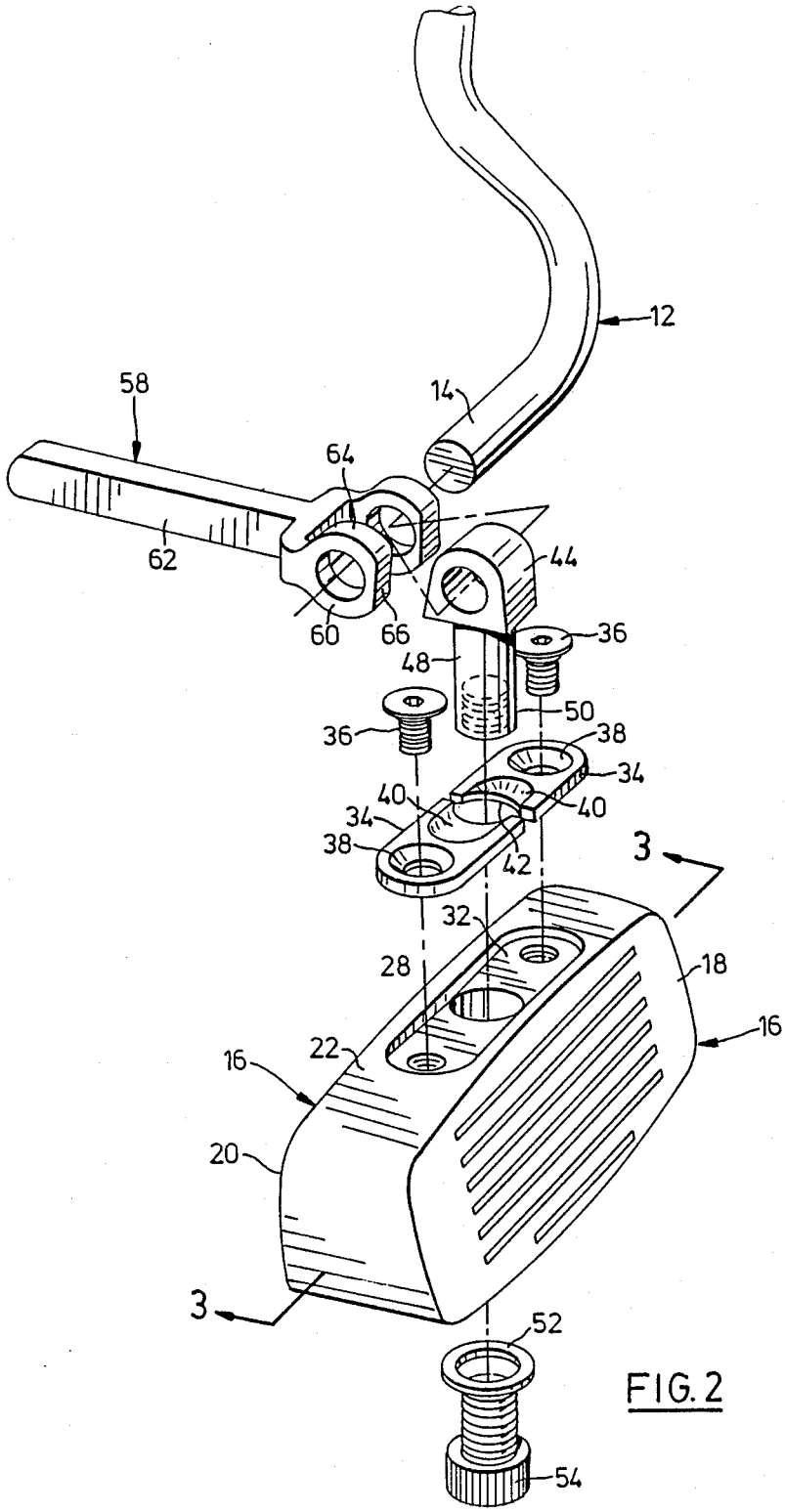
FIG. 2 is an exploded perspective view of the head of FIG. 2.
Figure 6:
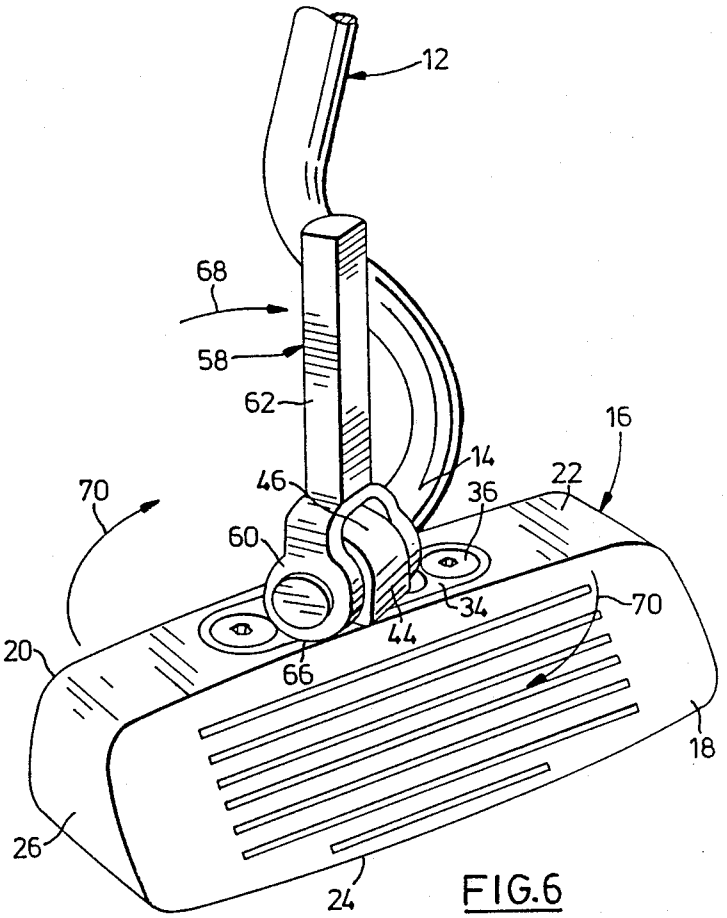
FIG. 6 is a perspective view similar to FIG. 5 showing the head being rotated from a position as a chipper to a position as a putter.
Figure 5:
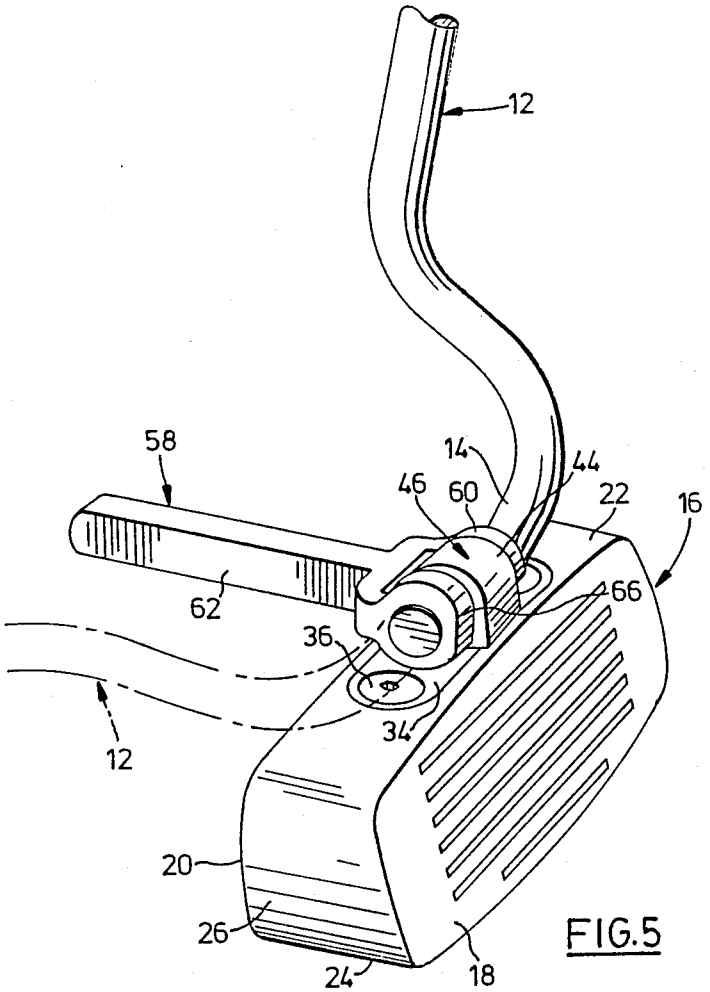
FIG. 5 is a perspective view of the head of the club of FIG. 1.

In the operation of the device, head 16 is rotatable 180° on pin 48 to present either chipper face 18 or putter face 20 for use in play. As seen in FIG. 1, head 16 is locked into a position, with lever arm 62 horizontally disposed, presenting chipper face 18 for use. In this position, as seen in FIGS. 5 and 6, the thicker portions of bosses 60 extend below trunnion 44 into depressions 40 of leaf springs 34 and depress the leaf springs in recess 32, thus releasably locking head 16 in that position on shaft 12. To present putter face 20 for use in play, lever arm 62 is raised to a vertical position in the direction of arrow 68 seen in FIG. 6 which moves central cam surfaces 66 of bosses 60 into juxtaposition with depressions 32 in leaf springs 34 and allows head 16 to be rotated on pin 48 in the axis of bore 28 in the direction of arrows 70 as seen in FIG. 6. When head 16 has been rotated 180° lever arm 62 is again lowered into a horizontal position which presses side cam surfaces 64 into recess 32 of leaf springs 34, locking head 16 in position for use of putter face 20 in play.

Lever 58 may be moved to point lever arm 62 in either horizontal direction, allowing use of club 10 by either a right handed or a left handed player. Also, lever arm 62 may be used as a sight alignment device.

It will be appreciated that the invention is applicable to any golf club such as an iron.

The golf club of the invention is actually a three position club, i.e. for use by a right handed (or left handed) player as (1) a putter, (2) a chipper, or (3) a reverse play putter or chipper (for instance where the ball is adjacent a tree). To comply with a rule that only two way clubs may be used, lever 58 could be modified to allow lever arm 62 to be moved into horizontal position to point in only one direction.

I claim:

1. A golf club comprising:

a shaft having a lower end angled for horizontal disposition when the club is in use;

a mounting element fixed on the lower end of the shaft and comprising a trunnion fixed to the lower end of the shaft and having a laterally projecting pin;

a head having opposed striking faces, the head being mounted on the element and being rotatable on the pin between selected positions presenting each face for play; and means to releaseably lock the head in each of said positions, the locking means comprising a bifurcated lever having an arm with a pair of spaced bosses loosely mounted on the lower end of the shaft and straddling the trunnion, each boss being shaped to form a cam interacting with the head whereby the lever is movable into alternate positions to lock and unlock the head.

2. A golf club as claimed in claim 1 in which the head includes a recess adjacent the bosses of the lever, the cams of the bosses being registrable with the recess.

3. A golf club as claimed in claim 2 including a pair of leaf springs mounted in the recess and depressable therein, the bosses being registrable with the springs.

4. A golf club as claimed in claim 3 in which the head includes a vertical bore centrally located therethrough terminating at its lower end in a recess, the pin being axially located in the bore, and means located in the recess to engage the pin loosely in the bore.

5. A golf club as claimed in claim 1 in which the lever arm extends horizontally normal to and rearwardly of the striking face presented for play when the head is in locked position.

* * * * *